US006041498A

United States Patent [19]

Hillbish et al.

[11] Patent Number: 6,041,498

[45] Date of Patent: Mar. 28, 2000

[54] METHOD OF MAKING A CONTACT ASSEMBLY

[75] Inventors: Warren Christian Hillbish, Hummelstown; Earl William McCleerey, Mechanicsburg, both of Pa.

[73] Assignee: The Whitaker Corporation, Wilmington, Del.

[21] Appl. No.: 09/104,829

[22] Filed: Jun. 25, 1998

Related U.S. Application Data

[62] Division of application No. 08/672,707, Jun. 28, 1996, Pat. No. 5,882,214.

[51] Int. Cl.[7] ..... H01R 43/00

[52] U.S. Cl. ..... 29/883

[58] Field of Search ..... 29/883, 622, 884, 29/842, 843, 844; 264/272.14, 272.15

[56] References Cited

U.S. PATENT DOCUMENTS

| | | | |
|---|---|---|---|
| 4,600,971 | 7/1986 | Rose et al. | 361/421 |
| 4,611,262 | 9/1986 | Galloway et al. | 361/421 |
| 4,673,837 | 6/1987 | Gingerich et al. | 310/239 |
| 4,753,608 | 6/1988 | Yamaguchi | 439/395 |
| 4,764,645 | 8/1988 | Takasawa | 29/883 X |
| 4,786,258 | 11/1988 | Shaffer et al. | 439/188 |
| 4,808,125 | 2/1989 | Waters et al. | 439/607 |
| 4,821,413 | 4/1989 | Schmitt et al. | 29/883 |
| 4,822,303 | 4/1989 | Nakamura et al. | 439/607 |
| 4,846,727 | 7/1989 | Glover et al. | 439/608 |
| 4,965,933 | 10/1990 | Mraz et al. | 29/883 X |
| 4,975,084 | 12/1990 | Fedder et al. | 439/608 |
| 5,046,960 | 9/1991 | Fedder | 439/108 |
| 5,066,236 | 11/1991 | Broeksteeg | 439/79 |
| 5,074,039 | 12/1991 | Hillbish et al. | 29/883 |
| 5,085,601 | 2/1992 | Buchter et al. | 439/660 |
| 5,104,329 | 4/1992 | Brown et | 439/108 |
| 5,104,341 | 4/1992 | Gilissen et al. | 439/79 X |
| 5,158,471 | 10/1992 | Fedder et al. | 439/79 X |
| 5,215,473 | 6/1993 | Brunker et al. | 439/108 |
| 5,342,211 | 8/1994 | Broeksteeg | 439/108 |
| 5,378,165 | 1/1995 | Comerci et al. | 439/188 |
| 5,399,105 | 3/1995 | Kaufman et al. | 439/609 |
| 5,403,206 | 4/1995 | McNamara et al. | 439/608 |
| 5,468,154 | 11/1995 | Yip et al. | 439/79 OR |
| 5,479,321 | 12/1995 | Mair et al. | 361/816 |
| 5,484,310 | 1/1996 | McNamara et al. | 439/608 |
| 5,496,183 | 3/1996 | Soes et al. | 439/79 |
| 5,651,685 | 7/1997 | Brinkman et al. | 439/79 X |

FOREIGN PATENT DOCUMENTS

| | | |
|---|---|---|
| 0374904 A1 | 6/1990 | European Pat. Off. . |
| 0422785 A2 | 4/1991 | European Pat. Off. . |
| 07260864 | 10/1995 | Japan . |
| 7-312269 | 11/1995 | Japan . |

*Primary Examiner*—Carl J. Arbes

[57] ABSTRACT

A contact assembly (90) includes separate conductive members (42,54) with insulative material (90) molded about body sections (50,64) to define an integral unit for handling during connector assembly. The method includes stamping the conductive members (656,658,660,662) from a common blank (680) to have beams (610,612,614,616) associated in pairs to define sockets (606,608), second contact sections (648,650,652,654) at other ends, and body sections (656, 658,660,662) joining the respective beams and second contact sections (648,650,652,654). Final separation of the conductive members may occur after molding of the insulative material (670), prior to which the conductive members may be retained on carrier strip facilitating the stamping, plating and molding processes. One contact assembly (604) provides sockets (606,608) having pairs of beams (610,612 and 614,616) with the beams defined on separate conductive members (640,642,644,646) and is inserted into a housing doubling the contact density of the connector without increasing the size of the housing.

15 Claims, 7 Drawing Sheets

METHOD OF MAKING A CONTACT ASSEMBLY

REFERENCE TO RELATED APPLICATION

This is a Divisional of U.S. patent application Ser. No. 08/672,707 filed Jun. 28, 1996, now U.S. Pat. No. 5,882,214.

FIELD OF THE INVENTION

The present invention relates to electrical connectors and more particularly to contacts insertable into a connector housing.

BACKGROUND OF THE INVENTION

Several varieties of electrical connectors are known in which the contact sections of a plurality of contacts of the connector are arrayed in rows and columns along the mating face, and optionally along another interconnection face such as a board-mounting face. In one such connector as disclosed in U.S. Pat. No. 5,066,236, several contacts include socket contact sections aligned in a column of the mating face and include right-angle rear portions along the connector's board-mounting face for connection to an array of through-holes of a circuit board to which the connector is to be mounted. The contacts are initially stamped and formed in lead frame form and then insulative material is molded to body sections of the contacts while the contacts are joined to a carrier strip, after which the joints of the contacts to the carrier strip are severed to separate the contacts. The unit thus formed is easily assembled along an assembly face of a housing opposite the mating face, along with a plurality of other such units to define the connector. In a similar connector disclosed in U.S. Pat. No. 5,496,183, a shield member is affixed to one side of the contact unit prior to being affixed to the housing.

It is desired to provide a compact multi-contact connector with simplified assembly.

It is further desired to provide a method of forming multi-contact units for insertion into a housing such that the contacts of the units are multi-functional.

It is also desired to provide a compact high-density connector.

SUMMARY OF THE INVENTION

The present invention provides a contact assembly in an electrical connector in which a plurality of isolated conductive members are fabricated into a discrete contact assembly unit insertable into a connector housing.

One embodiment of a contact assembly unit defines a switch that provides an electrical indication whether or not a mated condition exists. The mating indicator is an assembly of two (or more, in certain embodiments) electrically isolated conductive members that may be disposed in a single contact position or in a multi-contact column position of a multi-contact connector, with a first contact section being a socket having two cantilever beam arms, each of the arms being on a separate one of the conductive members. Body sections of the conductive members loin the arms to respective second contact sections that, when connected to separate circuit paths of a second electrical article such as a circuit board, provide an electrical signal when the arms of the socket are commoned by being engaged by a complementary contact of the mating connector during mating. The conductive members are physically held by insulative material molded about the body sections, for the mating indicator to be manipulated as a unit during assembly.

The connector with which the present invention is used may include an array of contacts having socket contact sections along the mating face in two or more rows where the contacts of the rows are preferably also aligned in columns. Each socket may be defined by a pair of opposed arms spaced apart to receive a pin contact section therebetween upon connector mating. Ground (or power) contacts of the connector can be disposed in a column and can be stamped from a blank as an integral member having two socket contact sections, two associated board-engaging contact sections and respective body sections therebetween while the ground contact remains part of an integral unit prior to and after assembly within the connector. Alternatively, ground (or power) contacts of the connector could also be disposed in rows and/or stamped individually in blank and become integral to have two socket contact sections, several associated board-engaging contact sections, and respective body sections therebetween.

In one embodiment, one of the initially integral ground (or power) contacts is split longitudinally into two separate members to obtain electrical isolation therebetween, preferably while the separate members are still joined to a single carrier strip for convenience of handling during fabrication. One member contains one of the socket contacts and its associated board-engaging contact section and a body section therebetween, and also includes one of the two arms or beams of the second socket contact section. The other piece includes the remaining arm of the second socket contact and the board-engaging contact section associated with the second socket contact section, and a body section therebetween. With each of the two arms being joined to a respective board-engaging contact section and a separate circuit path of the circuit board when the connector is mounted to the circuit board, the two arms of the second contact section will become commoned by a mating pin of a mating connector, completing an electrical circuit therebetween to indicate such mating.

Preferably in an insert molding process, insulative material is molded about body sections of the pair of now-severed contact halves (still joined to the carrier strip) to join the halves into a physical unit for convenience of manipulation as a unit during connector assembly as well as during service and repair. The insulative material also maintains the desired spacing between the contact arms at their bases for assured electrical isolation therebetween when unmated while enabling assured mating with a pin contact of a mating connector, since retention sections of the contacts may be defined by housing-engaging barbs along the bases for force-fit into housing passageways.

In another embodiment, a connector initially having a selected number of socket contacts in rows and columns along the mating face, can have its contact density doubled without enlarging the size of the connector or noticeably increasing connector mating forces. Each socket contact is bisected longitudinally such that each conductive member includes a rearward second contact section such as a board-mount post, with a body section joining the post to one beam of the original socket contact section. Upon mating with a laminated pin of a mating connector having isolated circuits on opposed sides of the pin, two independent isolated circuits are completed when each pin circuit engages a respective socket contact beam. One contact position can for example be a mating indicator by a conventional pin commoning the two beams of the socket contact assembly, or the beams of the socket contact assembly can be formed to be spring biased to an initially commoned engagement so that mating with a laminated pin separates the previously engaged beams and thus breaks the circuit.

Embodiments of the invention will now be described by way of example with reference to the accompanying drawings.

DETAILED DESCRIPTION

Figure 1:
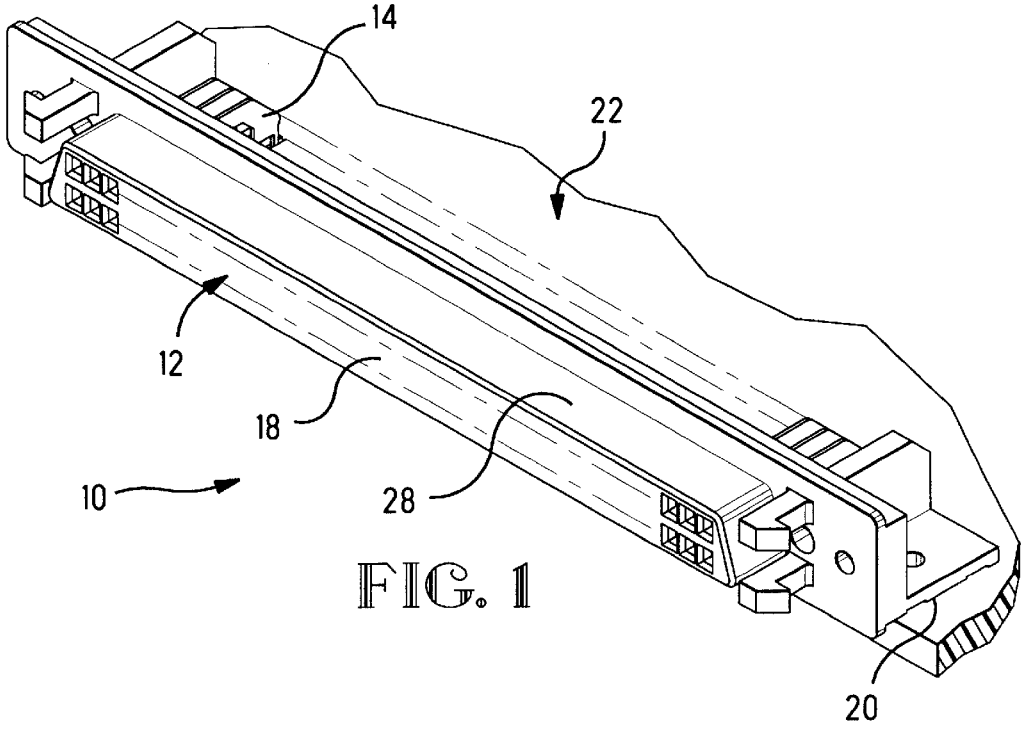
FIG. 1 is an isometric view of the connector containing the present invention.

Connector 10 in FIG. 1 includes an insulative housing 12 and an array of signal contacts 14 and ground (or power) contacts 16 (FIG. 2) extending from mating face 18 to board-mounting face 20, and is shown mounted onto a circuit board 22. Signal contacts 14 and ground contacts 16 include socket contact sections 24 exposed along mating face 18 to become mated with respective pin contact sections of contacts of a mating connector (not shown), and further include posts 26 extending from board-mounting face 20 to become electrically connected with circuits of a circuit board. Also shown is a conductive shell 28 surrounding housing 12 between mating face 18 and board-mounting face 20. Such a connector is disclosed in U.S. Pat. No. 4,808,125.

Figure 2:
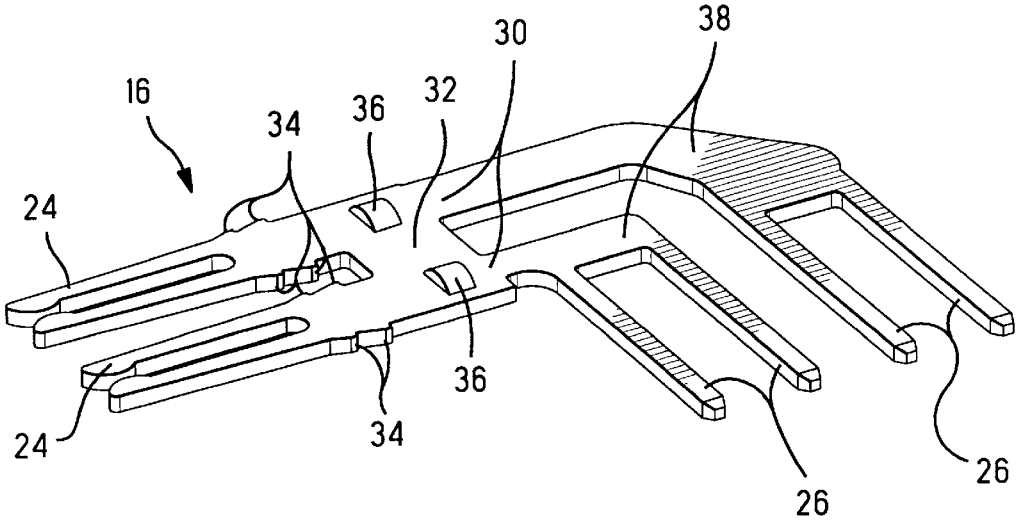
FIGS. 2 and 3 are isometric views of a ground contact, and also the conductive members of a mating indicator contact assembly of the connector of FIG. 1.

In FIG. 2 is shown a ground contact 16, with body sections 30 extending between each socket contact section 24 and a respective pair of posts 26, and is stamped from a blank. Providing a pair of posts for each socket contact section allows removal of one thereof, if only one is needed to transmit the particular current levels transmitted over the circuit defined by the contact, in order to correspond to the particular positioning of the rows of the corresponding through holes of the circuit board circuit. Since socket contact sections 24 may be commoned for grounding, body section 30 is integrally joined at isthmus 32 for ground contact 16 to be handled as a unit facilitating insertion. The ground contact is insertable into a slot of connector housing 12, with contact retention barbs 34 on edges of each body section 30 to achieve an interference fit with side walls of passageway portions of the housing adjacent the mating face and in communication with the vertical slot rearwardly therefrom. Each body section 30 also is seen to include an embossment 36 in engagement with one of the walls of the slot to optionally urge the contact against the opposed wall, thus stabilizing the position of the contact laterally. The embossment may also be utilized as a push surface to install the contact into the housing, remaining exterior to the housing cavity. Rearward body portions 38 adjacent pairs of posts 26 will extend rearwardly from the connector housing, and are spaced from each other.

Figure 3:
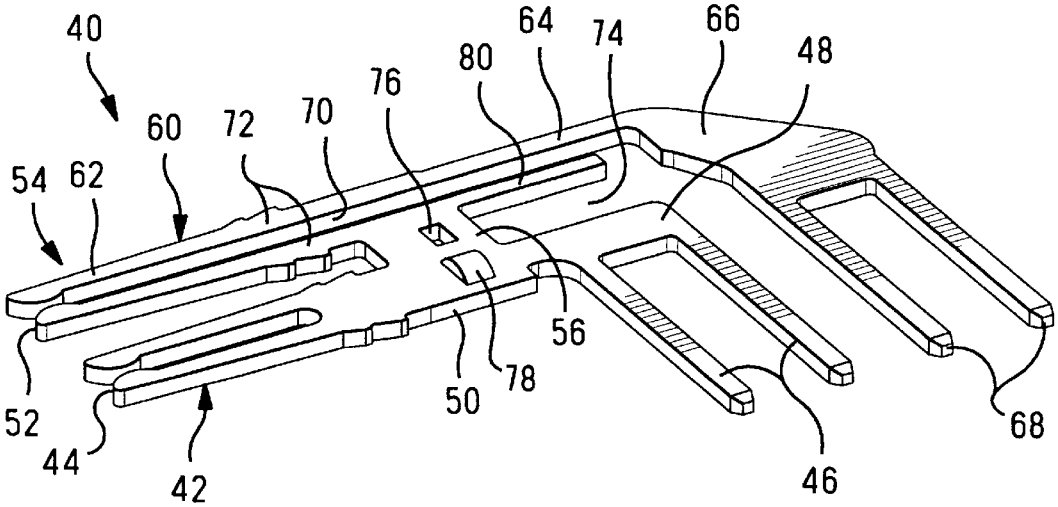
Figure 4:
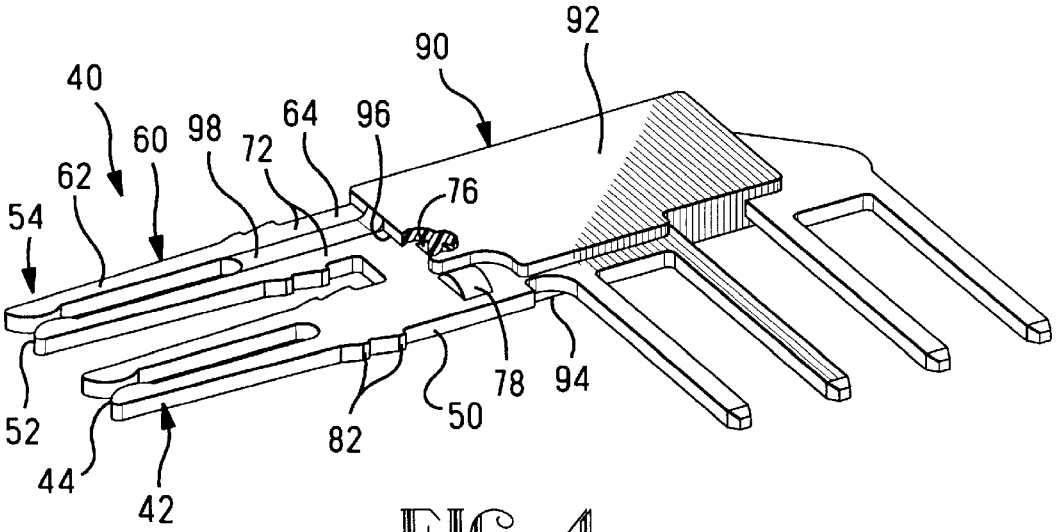
FIG. 4 is an isometric view of the mating indicator contact of FIG. 3 after molding of insulative material thereto.

In FIG. 3 and 4 is shown the mating indicator 40 of the present invention. Firstly, the mating indicator is stamped from a blank as with ground contact 16, but is also stamped such that two separate pieces are defined. A first piece 42 includes first socket contact section 44 and one set of posts 46 joined by rearward body portion 48 to a body section 50. First piece 42 further includes one cantilever beam 52 that defines half of a second socket contact section 54, with beam 52 being joined to body section 50 by isthmus 56. Second piece 60 includes a second cantilever beam 62 that defines the other half of second socket contact section 54, and second piece 60 further includes a body section 64 joining second cantilever beam 62 to rearward body portion 66 and a second set of posts 68. A gap 70 of selected narrow dimension is defined between bases 72 of cantilever beams 52,62 of the two pieces and between body sections 50,64 to communicate with large recess 74 between rearward body portions 48,66, with the narrow dimension being sufficient to assure electrical isolation of pieces 42,60. Preferably a small aperture 76 is stamped through isthmus 56. An embossment 78 is formed on body section 50, as in ground contact 16 of FIG. 2, to stabilize the mating indicator in the housing slot upon assembly, or to be utilized as a push surface to install the contact into the housing, remaining exterior to the housing cavity. Section 80 of body section 64 rearwardly of isthmus 56 is embedded within the insulative material 90 (FIG. 4), providing for an enhanced physical gripping of the plastic material on the conductive member, and also stabilizing first cantilever beam 52 against lateral stresses during handling and also during in-service use of the connector. Also, side edges of bases 72 are seen to be provided with retention barbs 82, as in ground contacts 16 of FIG. 2.

FIG. 4 illustrates indicator 40 after molding of insulative material 90 about body sections 50,64 of pieces 42,60 thus defining a physical unit for handling and assembly of the mating indicator into the housing. Insulative material 90 includes side portions 92,94 defining major surfaces parallel to the axes of the contacts of the connector, with the two side portions integrally joined at several locations including gap 70 and large recess 74 between the rearward body portions of the two pieces that extend rearwardly from the rear face of the connector housing. Insulative material is disposed within aperture 76 to form a column of material extending between and joining side portions 92,94 adjacent forward edges 96 of insulative material 80. A narrow flange 98 is also defined between base portions of cantilever beams 52,62 of second contact section 54, for supporting retention barbs 34 of beams 52,62 against wall portions of the forward housing passageway portion within which socket contact section 54 is disposed.

The metal utilized to define the conductive members may be for example phosphor bronze plated at the socket contact sections preferably with gold to enhance longevity of the contact during repeated mating cycles during in-service use of the connector, and plated at the board-mounting contact sections preferably with tin/lead to facilitate soldering. Various plastic materials may be used in the molding process, preferably that are temperature-stable, nonhygroscopic such as liquid crystal polymer.

Upon mating of connector 10 and a mating connector (not shown), a pin contact becomes electrically engaged with second socket contact section 54 electrically commoning first and second cantilever beams 52,62 thereof and thus completing the circuit between members 42,60 which is detected by the circuitry of the circuit board to indicate the mated condition.

It may be discerned that a mating indicator may be devised that comprises only a single socket contact portion, with the respective cantilever beam arms joining respective body sections extending to respective ones of the pair of board-engaging posts, such that the posts are connectable to respective circuits paths of the circuit board. Such separate conductive members may easily be insert molded to provide insulative material surrounding the body sections and filling the gap or spacing therebetween.

Figure 5:
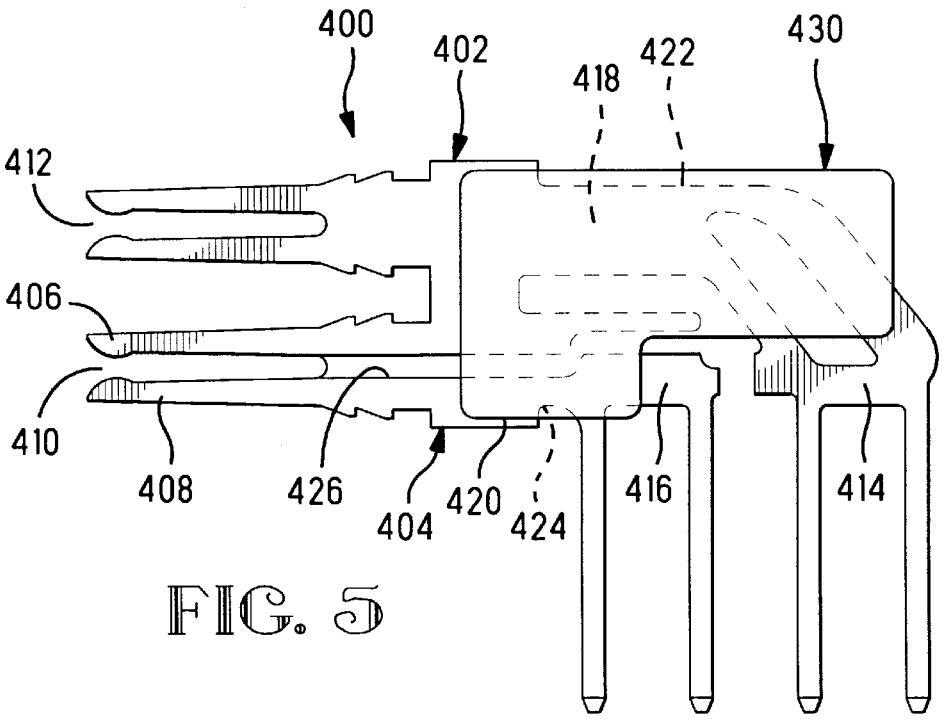
FIGS. 5 and 6 are isometric views similar to FIG. 3, of additional embodiments of the present invention.
Figure 6:
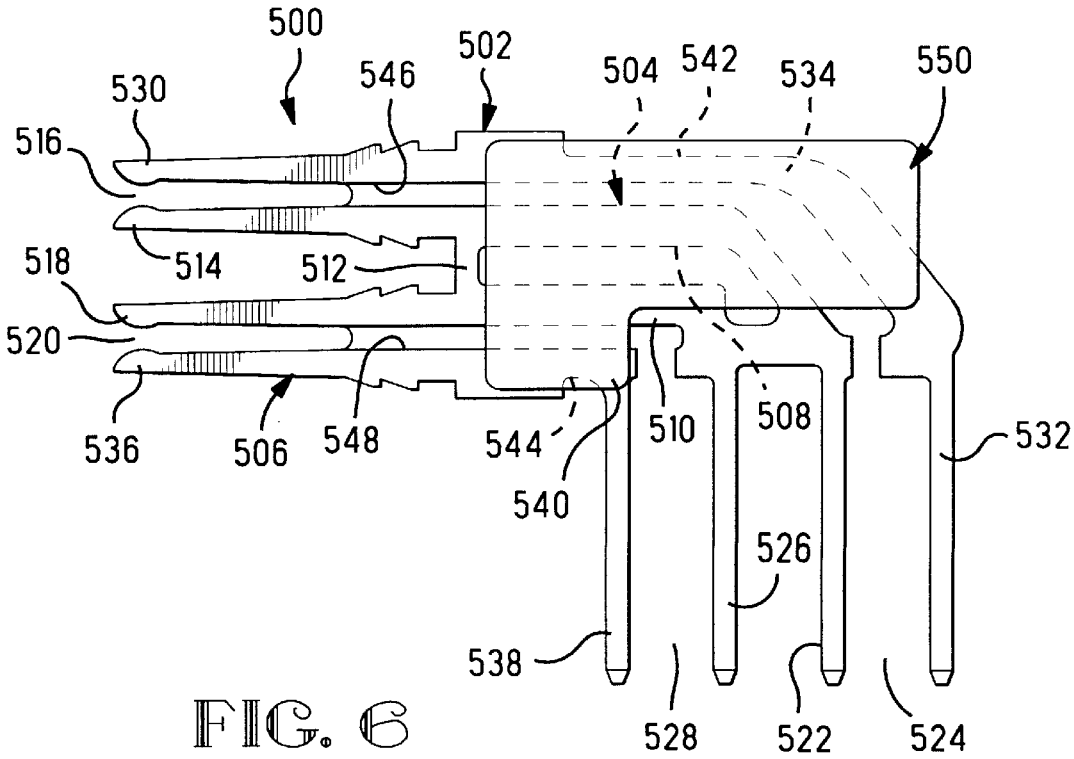

FIGS. 5 and 6 illustrate additional embodiments of the present invention. In FIG. 5, a mating indicator 400 is shown that is similar to the indicator of FIGS. 3 and 4 after molding insulative material about the separate conductive members stamped from a common blank. However, in FIG. 5 the separate conductive members 402,404 each include one of the beams 406,408 of the lower socket contact section 410. Upper conductive member 402 defines the entirety of the upper socket contact section 412 and the second contact section 414 associated therewith. Lower conductive member 404 includes the second contact section 416 associated with the lower socket contact section 410, Insulative material 430 is molded over body sections 418,420 similarly to what is shown in FIG. 4, and manipulation as a unit would also be similarly enabled during connector assembly as well as during service and repair Insulative material 430 preferably is molded to extend beyond at least portions of the upper edge 422 of upper conductive member 402 and the lower edge 424 of lower conductive member 404 thereby surrounding and embedding body portions 418,420, as well as fill gap 426 between the conductive members to maintain the members a fixed selected distance from each other for assured electrical isolation.

In FIG. 6 mating indicator embodiment 500 shows three discrete conductive members 502,504,506 formed from a single metal blank with insulative material 550 molded thereto. Central conductive member 504 includes body sections 508,510 joined by an isthmus 512, with body section 508 mechanically and electrically integral with lower beam 514 of upper socket contact 516, upper beam 518 of lower socket contact section 520, forward post 522 of second contact section 524 associated with upper socket contact section 516, and rearward post 526 of second contact section 528 associated with lower socket contact section 520. Upper conductive member 502 comprises upper beam 530 of upper socket contact section 516 and rearward post 532 of second contact section 524, joined by body section 534. And lower conductive member 506 comprises lower beam 536 of lower contact section 520 and forward post 538 of second contact section 528, joined by body section 540. Insulative material 550 preferably is molded to extend beyond at least portions of the upper edge 542 of upper conductive member 502 and the lower edge 544 of lower conductive member 506 thereby surrounding and embedding all body sections 534,508,510,540, as well as fill gaps 546,548 between the three conductive members to maintain the members a fixed selected distance from each other for assured electrical isolation. Pin contacts received into upper and lower socket contact sections 516,520 common the upper and lower conductive members 502,506 to central conductive member 504, thus closing the respective circuits on the circuit board to which posts 532,538 and commoned posts 522,526 are electrically connected.

Figure 7:
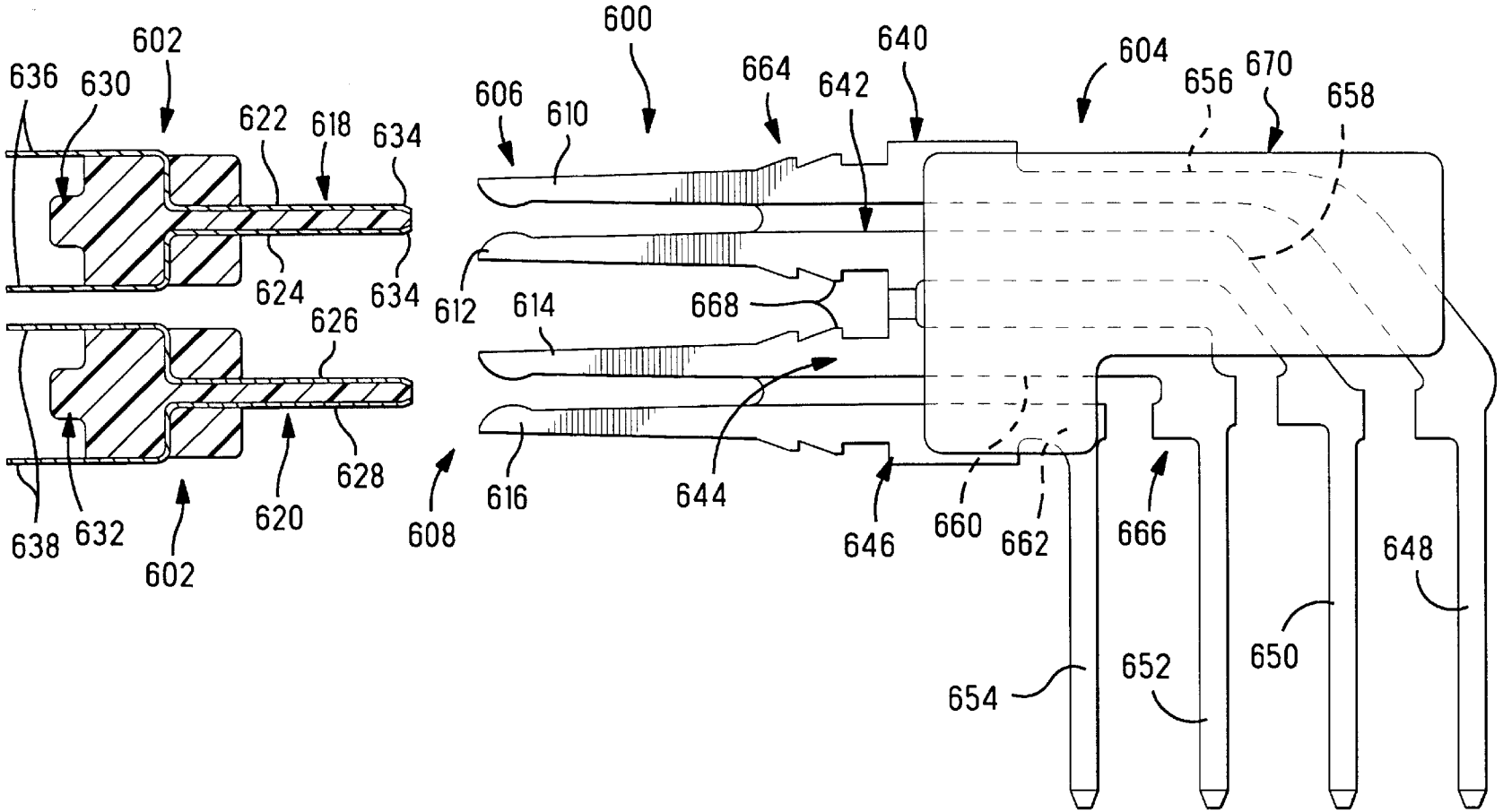
FIGS. 7 and 8 illustrate another embodiment of contact assembly of the present invention, in which each socket contact section is bisected so that the beams are defined on separate conductive members to form two isolated circuits when mated with a complementary pin having two separate and isolated conductive portions.
Figure 8:
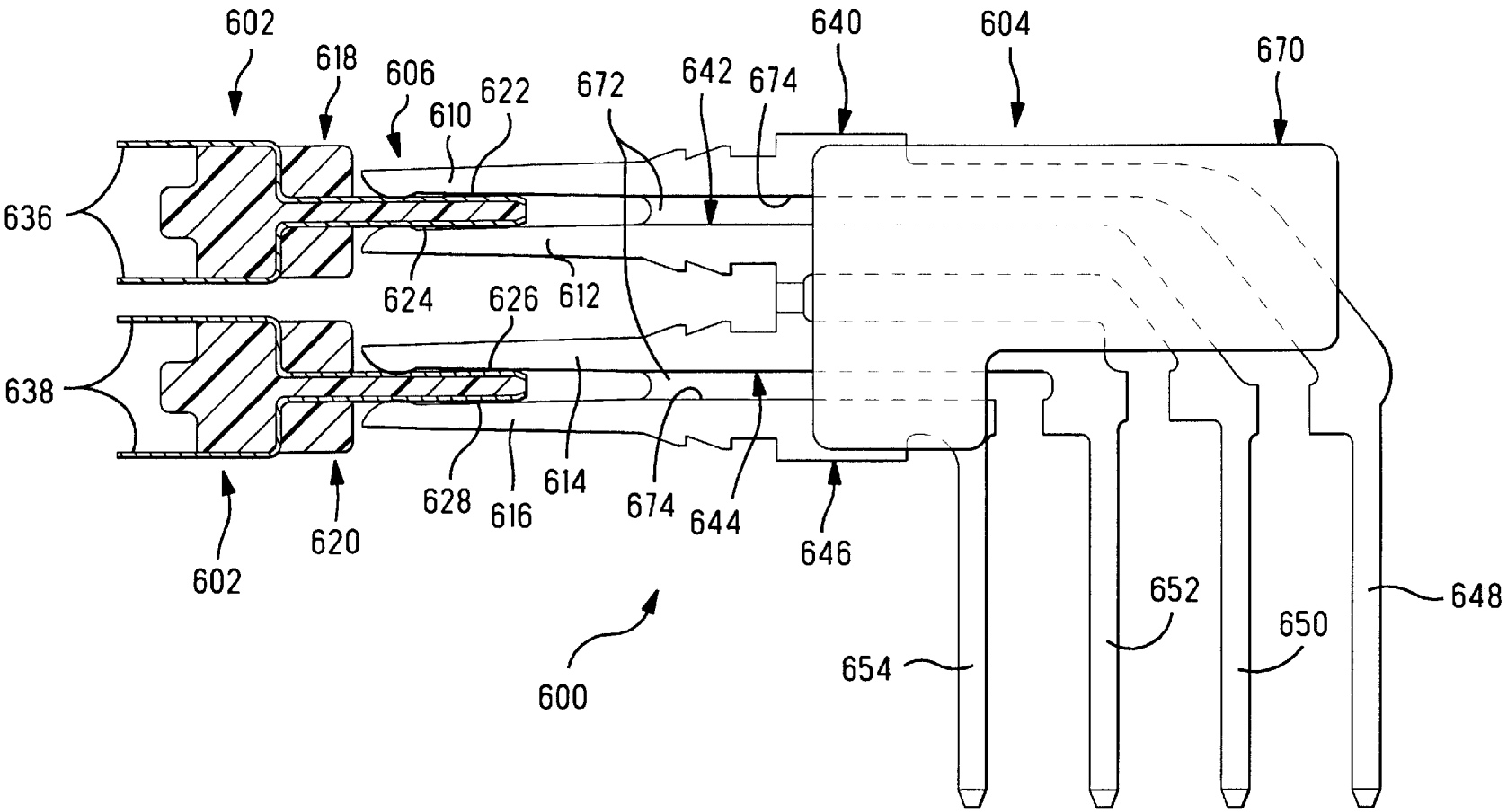
Figure 9:
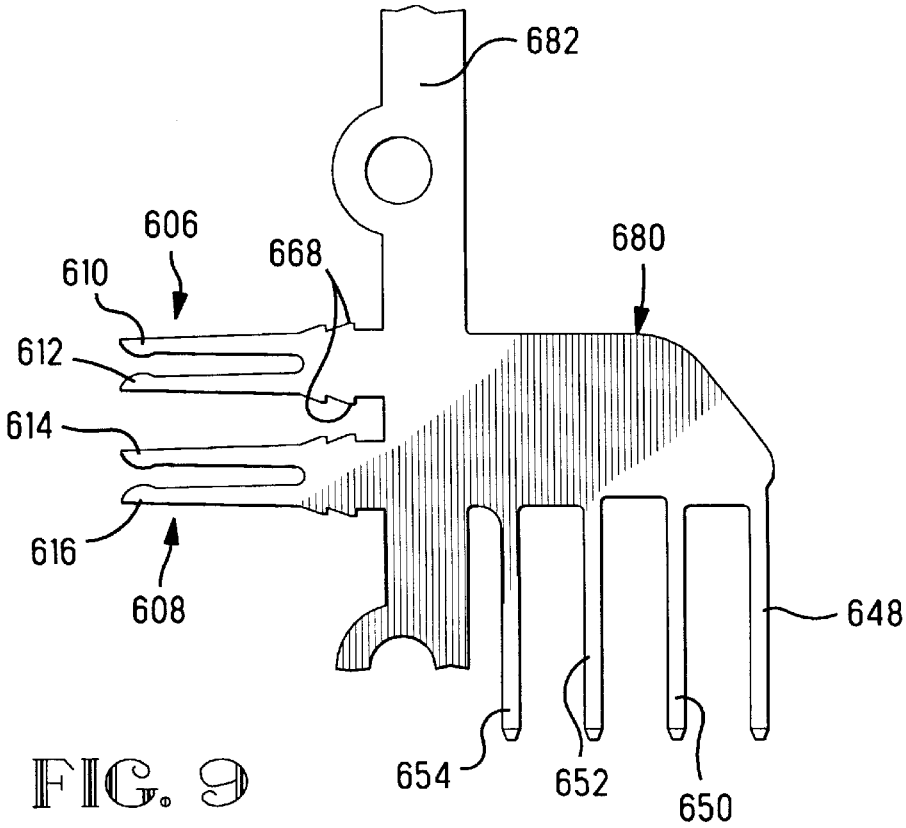
FIGS. 9 to 12 illustrate the fabrication of the contact assembly of FIGS. 7 and 8 from stamped blank to fabricated unit.

A high density connector may be derived from the matable contact assembly embodiment 600 of FIGS. 7 to 12, useful in many industries such as the computer industry wherein space requirements are more and more critical. In FIGS. 7 and 8 is shown contact assembly 604 being mated with complementary pin contact assemblies 602. Contact assembly 604 includes upper and lower sockets 606,608 each comprising upper and lower cantilever beam arms 610,612;614,616; each socket is matable with a respective composite pin 618,620 each comprising upper and lower conductors 622,624;626,628 associated with the respective arms of the sockets.

Each pin, for example, includes its pair of conductors as discrete stamped and formed members about which insulative material 630,632 is molded such as by using temperature stable, nonhygroscopic liquid crystal polymer having limited shrinkage after molding, and which is sufficiently adherable to the conductors, for contact surfaces 634 to be exposed along the pin in the front, and post sections 636,638 along the rear face for electrical connection. The conductors of the pins are stamped of a stock of sufficient thickness to allow for the insert molding to be accomplished without violating the outside envelope of a pin of standard thickness, thus allowing for the doubling of the number of signal contacts without increasing the required mating forces. The pin contact assemblies may be mounted into a common insulative housing (not shown) or may be mounted onto a circuit element such as a circuit board (not shown) by soldering the posts in through-holes.

Each beam 610,612;614,616 is defined at a first end of a respective conductive member 640,642;644,646 isolated from the other conductive members. A second contact section 648,650,652,654 is defined at a second end of a conductive member, and the beams and second contact sections are integrally joined by a respective body section 656,658, 660,662. As a result, isolated electrical circuits are created extending from mating face 664 to an other face such as board-mounting face 666 of the assembly. Insulative material 670 is molded around the body sections of the conductive members to define an integral assembly manipulatable as a unit during handling facilitating connector assembly and also repair and servicing. Retention barbs 668 are defined along outer edges of bases of all sockets 606,608, for establishing an interference fit within passageway portions of the housing (see FIG. 1) into which contact assembly 604 is inserted.

Upon mating, pins 618,620 are received into respective ones of sockets 606,608, with conductors 622,624;626,628 electrically engaged with respective ones of beams 610, 612;614,616 to complete respective circuits within the mated assembly, as illustrated in FIG. 8.

FIGS. 9 to 12 illustrate the fabrication procedure for manufacture of contact assembly 604 such as by using progressive dies and a mold apparatus. A blank of the assembly is stamped in FIG. 9 to define sockets 606,608 having beams 610,612;614,616, and to have posts 648,650, 652,654 for board-mountable second contact sections, and preferably the blank is kept on carrier strip 682 for convenience in manufacture for further stamping and forming and for plating.

Figure 10:
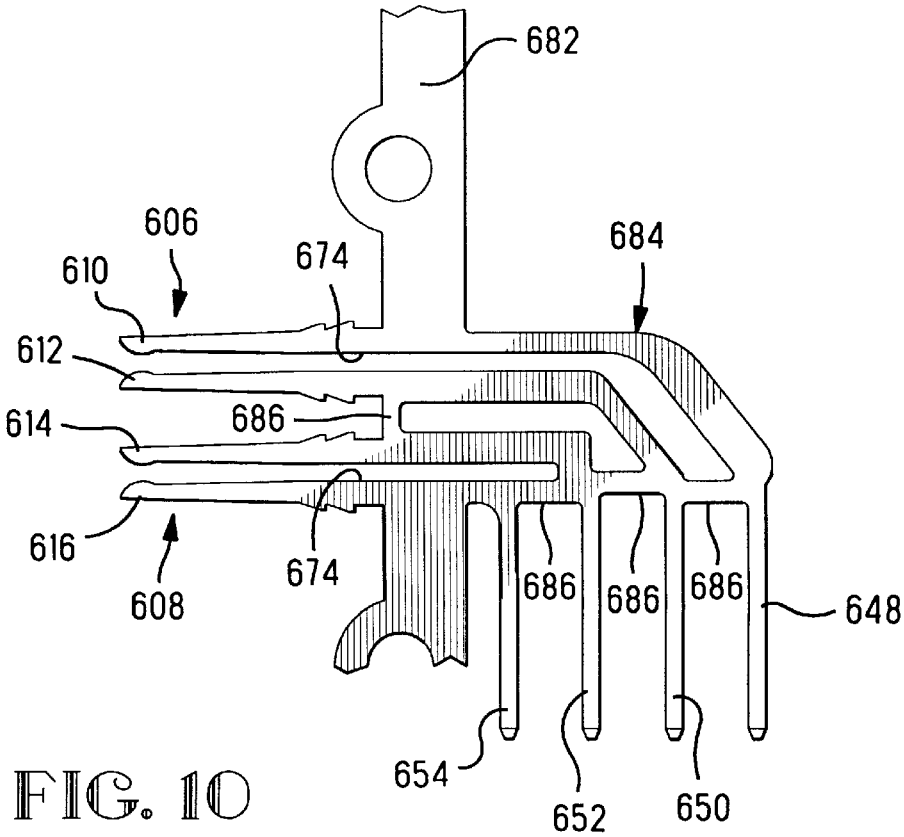

In FIG. 10, further stamping has defined a lead frame wherein the body sections 656,658,660,662 are given general form and defining precisely dimensioned gaps 674, but remain joined temporarily at bights 686 at bases of the beams and the posts.

Figure 11:
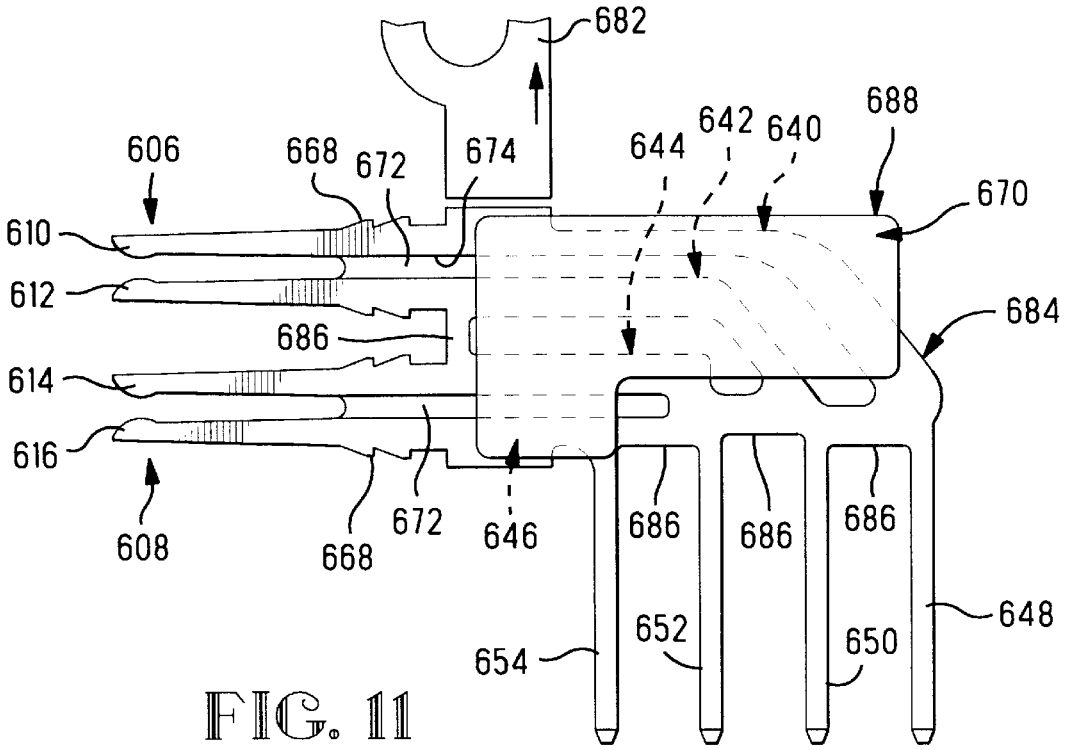

In FIG. 11, insulative material 670 such as temperature-stable, nonhygroscopic liquid crystal polymer, has been molded about body sections 656,658,660,662 in a manner exposing bights 686 and filling gaps 674 especially forming flanges 672 of insulative material at the bases of the beams 610,612,614,616 inwardly of retention barbs 668, all defining a "chicklet". Carrier strips 682 are now removed.

Figure 12:
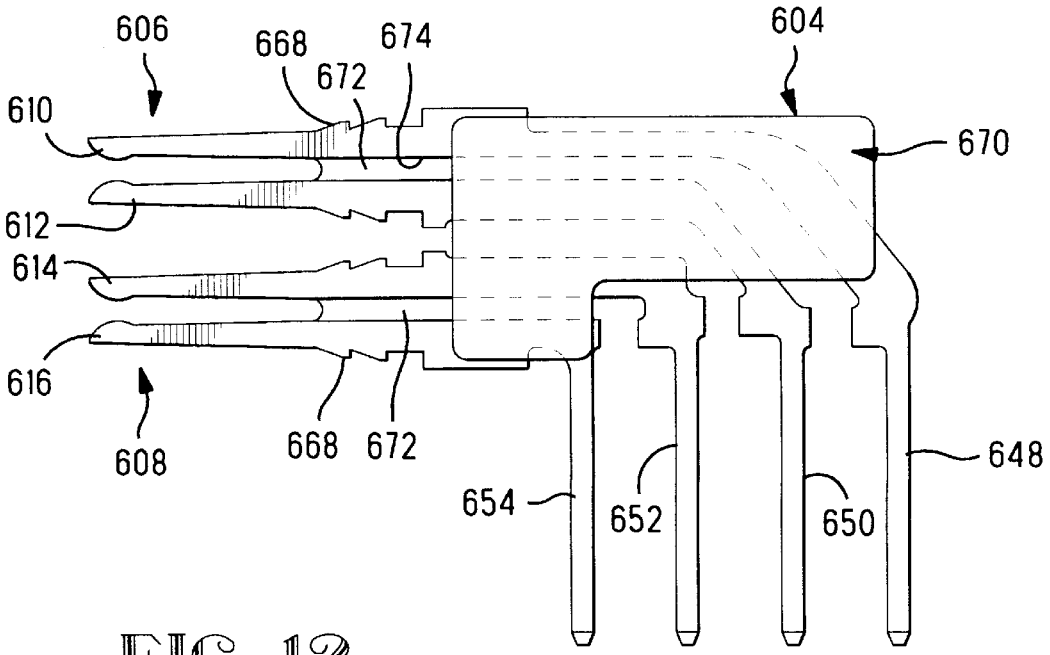

In FIG. 12, bights 686 are removed, fully separating the conductive members into discrete separate circuits, defining contact assembly 604.

Other modifications and revisions may occur to the mating indicator disclosed herein, that are within the spirit of the invention and the scope of the claims.

What is claimed is:

1. A method for making a contact assembly, comprising the steps of:

forming first and second contact pieces having beams of contact sections thereon and respective board engaging posts thereon, and further forming a gap between said first and said second contact pieces, using said gap to separate a first beam of said beams on a first contact section of said contact sections from a second beam of said beams on said first contact section, positioning said first beam and said second beam adjacent each other for receiving a pin into connection therewith, and for the pin to make an electrical connection between said first beam and said second beam, and imbedding said first and second contact pieces in insulating material with said posts protruding from said insulating material to make connections to a board, and with said first beam and said second beam protruding from said insulation material to make an electrical connection to said pin, whereby, upon said first beam and said second beam of said first contact section making connection to said pin, an electrical connection is established between said first contact piece and said second contact piece.

2. A method as recited in claim 1, and further comprising the steps of:

making duplicates of said contact assembly, and assembling contact sections on said contact assembly and said duplicates of said contact assembly into passages in a housing of an electrical connector, with posts on said contact assembly and said duplicates of said contact assembly projecting from said passages for connection to a board.

3. A method as recited in claim 1, and further comprising the steps of:

forming a flange on said insulating material that extends from a main section of said insulating material and that extends in said gap that is used to separate said first beam and said second beam, and extending said flange beside bases on said first beam and said second beam.

4. A method as recited in claim 1, wherein said step of forming first and second contact pieces having beams of contact sections thereon, further comprises the step of:

forming projecting barbs on edges of bases on said first beam and said second beam, and further comprising the steps of:

forming a flange on said insulating material that extends from a main section of said insulating material and that extends in said gap that is used to separate said first beam and said second beam, and extending said flange beside said bases on said first beam and said second beam.

5. A method as recited in claim 1, wherein said step of forming first and second contact pieces having beams of contact sections thereon, further comprises the step of:

forming said first beam of said first contact section on said first contact piece together with forming further beams of a further contact section on said first contact piece.

6. A method as recited in claim 1, and further comprising the steps of:

forming a third contact piece having a first additional beam of a second contact section thereon and having at least one additional board engaging post thereon, forming said first beam of said first contact section on said first contact piece together with forming a second additional beam of said second contact section on said first contact piece and further forming an additional gap between said first and said third contact pieces, using said additional gap to separate said first additional beam on said second contact section from said second additional beam on said second contact section, positioning said first additional beam and said second additional beam adjacent each other for receiving a corresponding pin into connection therewith, and for the corresponding pin to make an electrical connection between said first additional beam and said second additional beam, and wherein the step of imbedding said first and second contact pieces in insulating material further comprises the step of:

imbedding said third contact piece in said insulating material with said at least one additional board engaging post protruding from said insulating material to make a connection to a board, and with said first additional beam and said second additional beam protruding from said insulation material to make an electrical connection to said corresponding pin, whereby, upon said first additional beam and said second additional beam making connection to said corresponding pin, an electrical connection is established between said first contact piece and said third contact piece.

7. A method for making a contact assembly, comprising the steps of:

forming first and second contact pieces having portions of contact sections thereon and respective board engaging posts thereon, and further forming a gap between said first and said second contact pieces, using said gap to separate a first portion of a first contact section from a second portion of said first contact section, positioning said first portion of said first contact section and said second portion of said first contact section adjacent each other for receiving a pin into connection therewith, and for the pin to make an electrical connection between said first portion of said first contact section and said second portion of said first contact section, and imbedding said first and said second contact pieces in insulating material, with said posts protruding from said insulating material for connection to a board, and with said first portion and said second portion protruding from said insulation material for making connection to said pin, whereby, upon said first portion and said second portion of said first contact section making connection to said pin, an electrical connection is established between said first contact piece and said second contact piece.

8. A method as recited in claim 7, and further comprising the steps of:

making duplicates of said contact assembly, and assembling contact sections on said contact assembly and said duplicates of said contact assembly into passages in a housing of an electrical connector, with posts on said contact assembly and said duplicates of said contact assembly projecting from said passages for connection to a board.

9. A method as recited in claim 7, and further comprising the steps of:

forming a flange on said insulating material that extends from a main section of said insulating material and that extends in said gap that is used to separate said first portion and said second portion, and extending said flange beside bases on said first portion and said second portion.

10. A method as recited in claim 7, wherein said step of forming first and second contact pieces having portions of contact sections thereon, further comprises the step of:

forming projecting barbs on edges of bases on said first portion and said second portion, and further comprising the steps of:

forming a flange on said insulating material that extends from a main section of said insulating material and that extends in said gap that is used to separate said first portion and said second portion, and extending said flange beside said bases on said first portion and said second portion.

11. A method as recited in claim 7, wherein said step of forming first and second contact pieces having portions of contact sections thereon, further comprises the step of:

forming said first portion of said first contact section on said first contact piece together with forming further portions of a further contact section on said first contact piece.

12. A method of making a contact assembly, as recited in claim 7, and further comprising the steps of:

forming a third contact piece having a first additional portion of a second contact section thereon and having at least one additional board engaging post thereon, forming said first additional portion of said second contact section on said first contact piece together with forming a second additional portion of said second contact section on said first contact piece and further forming an additional gap between said first and said third contact pieces, using said additional gap to separate said first additional portion on said second contact section from said second additional portion on said second contact section, positioning said first additional portion and said second additional portion adjacent each other for receiving a corresponding pin into connection therewith, and for the corresponding pin to make an electrical connection between said first additional portion and said second additional portion, and wherein the step of imbedding said first and second contact pieces in insulating material further comprises the step of:

imbedding said third contact piece in said insulating material with said at least one additional board engaging post protruding from said insulating material to make a connection to a board, and with said first additional portion and said second additional portion protruding from said insulation material to make an electrical connection to said corresponding pin, whereby, upon said first additional portion and said second additional portion making connection to said corresponding pin, an electrical connection is established between said first contact piece and said third contact piece.

13. A method as recited in claim 12, and further comprising the steps of:

making duplicates of said contact assembly, and assembling contact sections on said contact assembly and said duplicates of said contact assembly into passages in a housing of an electrical connector, with posts on said contact assembly and said duplicates of said contact assembly projecting from said passages for connection to a board.

14. A method as recited in claim 12, and further comprising the steps of:

forming an additional flange on said insulating material that extends from a main section of said insulating material and that extends in said additional gap that is used to separate said first additional portion and said second additional portion, and extending said additional flange beside bases on said first additional portion and said second, additional portion.

15. A method as recited in claim 12, and further comprising the steps of:

forming projecting barbs on edges of bases on said first additional portion and said second additional portion, forming an additional flange on said insulating material that extends from a main section of said insulating material and that extends in said additional gap that is used to separate said first additional portion and said additional second portion, and extending said additional flange beside said bases on said first additional portion and said additional second portion.

* * * * *